US006904947B1

(12) United States Patent
Bailey et al.

(10) Patent No.: US 6,904,947 B1
(45) Date of Patent: Jun. 14, 2005

(54) APPARATUS FOR WRAPPING ARTICLES, PARTICULARLY GROUPS OF CIGARETTES

(75) Inventors: Thomas William Bailey, Conventry (GB); Robert Howard Taylor, Conventry (GB)

(73) Assignee: Molins PLC, Coventry (GB)

( * ) Notice: Subject to any disclaimer, the term of this patent is extended or adjusted under 35 U.S.C. 154(b) by 302 days.

(21) Appl. No.: 10/009,296

(22) PCT Filed: Jun. 2, 2000

(86) PCT No.: PCT/GB00/02147

§ 371 (c)(1),
(2), (4) Date: Apr. 3, 2002

(87) PCT Pub. No.: WO00/75017

PCT Pub. Date: Dec. 14, 2000

(30) Foreign Application Priority Data

Jun. 7, 1999 (GB) ..... 9913223

(51) Int. Cl.[7] ..... B65B 11/28

(52) U.S. Cl. ..... 156/498; 53/463; 53/466; 53/223; 53/234

(58) Field of Search ..... 156/498; 53/233, 53/234, 466, 463

(56) References Cited

U.S. PATENT DOCUMENTS 2,603,925 A * 7/1952 Moore ..... 53/51
3,136,104 A * 6/1964 Geer et al. ..... 53/234
4,179,976 A * 12/1979 Sygnator ..... 411/413
4,330,976 A * 5/1982 Blackall et al. ..... 53/151
5,442,894 A * 8/1995 Ogata et al. ..... 53/234

FOREIGN PATENT DOCUMENTS

EP 0514203 A * 11/1992
EP 0553636 A * 8/1993
GB 2206327 A * 1/1989
GB 2235913 A * 3/1991
GB 2258187 A * 2/1993

* cited by examiner

*Primary Examiner*—Blaine Copenheaver
*Assistant Examiner*—Barbara J Musser
(74) *Attorney, Agent, or Firm*—Antonelli, Terry, Stout & Kraus, LLP

(57) ABSTRACT

In a wrapping apparatus, particularly for enclosing articles consisting of or containing groups of cigarettes in wrapper material, the articles are received in a pocketed drum in which at least one overlapped region of the wrapper material is heat scaled. Preferably opposed side seams and an end flap of the wrapper are sealed, so as substantially to complete the enclosure of the article while on the drum. Side seal heaters carried by the drum may be mounted on respective annular carriers which are rotatably displaceable to remove the heaters from contact with the articles if the drum is stopped for an extended period. End seal heaters may be pivotally mounted on the drum and operated by a cam arrangement to fold an end flap of the wrapper into an overlapped position.

29 Claims, 4 Drawing Sheets

APPARATUS FOR WRAPPING ARTICLES, PARTICULARLY GROUPS OF CIGARETTES

This invention relates to a wrapping apparatus and method, particularly but not exclusively for wrapping articles including or containing groups of rod-like articles of the tobacco industry such as cigarettes or cigarette filter rods.

Cigarette packs, particularly those comprising a hinged lid pack, are commonly wrapped in heat sealable transparent plastics wrapper material, which assists in protecting the packet and maintaining freshness of its contents. So-called soft packs have a wrapper material, often including a metal layer or a metalised plastics laminate, which is sealed around a group of cigarettes. WO98/22367 and WO98/22368 disclose a cigarette pack in which wrapper material comprising a sealed barrier layer, which may comprise a metalised plastics laminate, is formed around a group of cigarettes partly surrounded by an inner frame. The present invention is particularly but not exclusively useful in connection with wrapping articles including or containing groups of cigarettes in the production of packs in any of these styles.

According to one aspect of the invention, apparatus for wrapping articles, particularly articles consisting of or containing groups of rod-like articles, comprises a rotary conveyor provided with a series of locations each of which is arranged to receive at a first rotational position of the conveyor an article and a wrapper at least partly surrounding the article and having at least one overlapped region, and heat sealing means carried with the conveyor and arranged to heat seal said overlapped region before discharge of the article and wrapper at a second rotational position of the conveyor.

According to another aspect of the invention, a method of wrapping articles, particularly articles consisting of or containing groups of rod-like articles, comprises the steps of conveying an article and a wrapper at least partly surrounding the article on a rotary path, and forming at least one heat seal at an overlapped region of the wrapper on said path. In a preferred arrangement, wherein said overlapped region includes spaced regions for forming side seals, the method includes the step of forming side seals on substantially opposite sides of said article substantially simultaneously on said path. At least one end seal may be formed on said path, and the method may include the step of folding an end flap into an overlapped position on said path prior to forming said at least one end seal.

As mentioned, the apparatus and method of the invention may be used in the wrapping of cigarette groups in wrapper material, eg to wrap cigarette packs, or in the production of soft packs or packs of the type disclosed in said WO97/42097 or WO97/42098. However, it will be appreciated that the invention is applicable to wrapping other articles, particularly those articles each having generally the shape of a right parallelepiped, irrespective of its constituents or contents.

Although it is preferred that the material of the wrapper is itself heat-sealable, the invention is applicable also to materials to which an adhesive which can be set or dried by heat has been applied at appropriate places in relation to the overlapped region to be sealed.

The invention will be further described, by way of example only, with reference to the accompanying diagrammatic drawings, in which.

Figure 1:
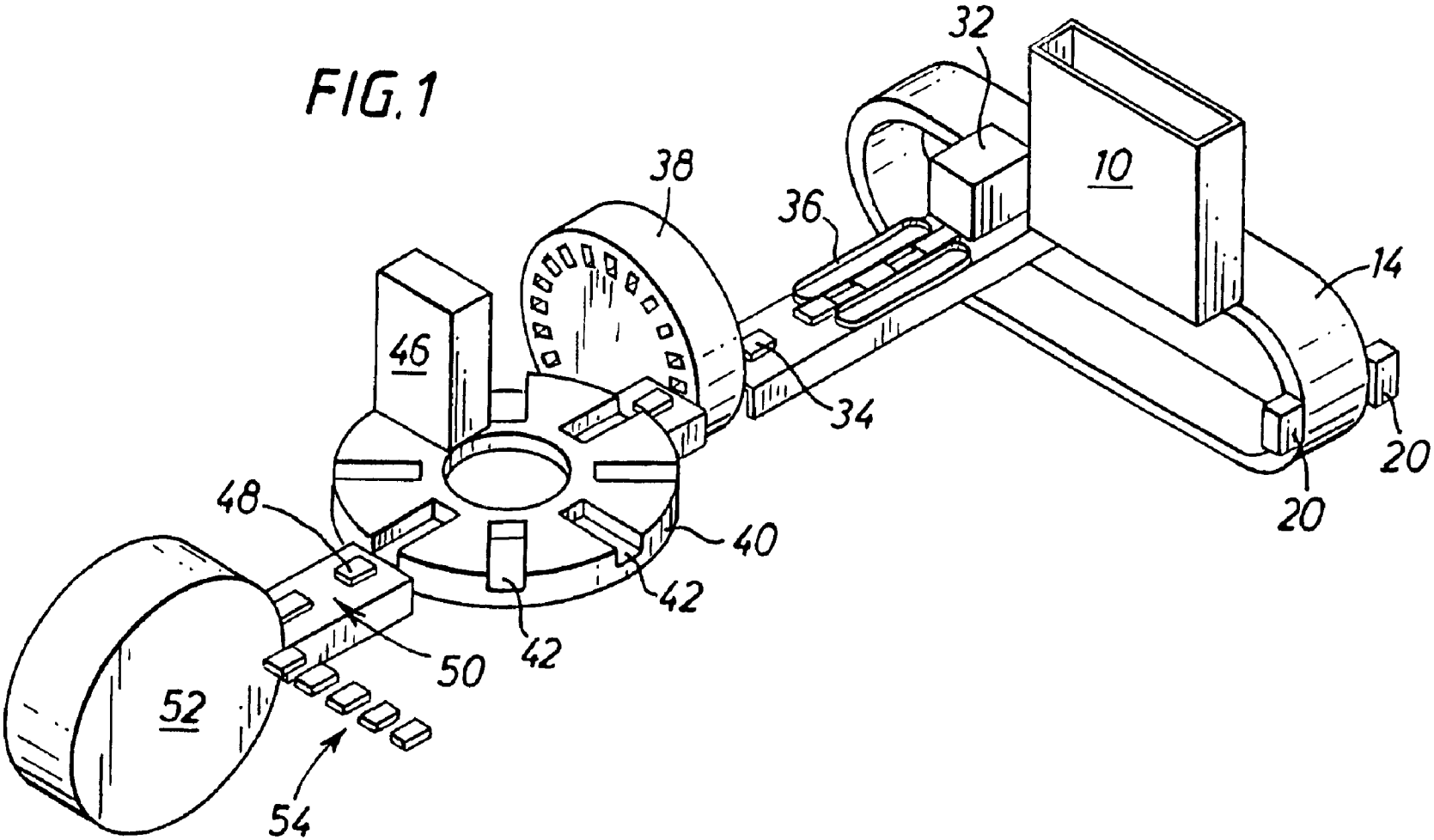
FIG. 1 is a perspective schematic view of a cigarette packing machine.
Figure 2:
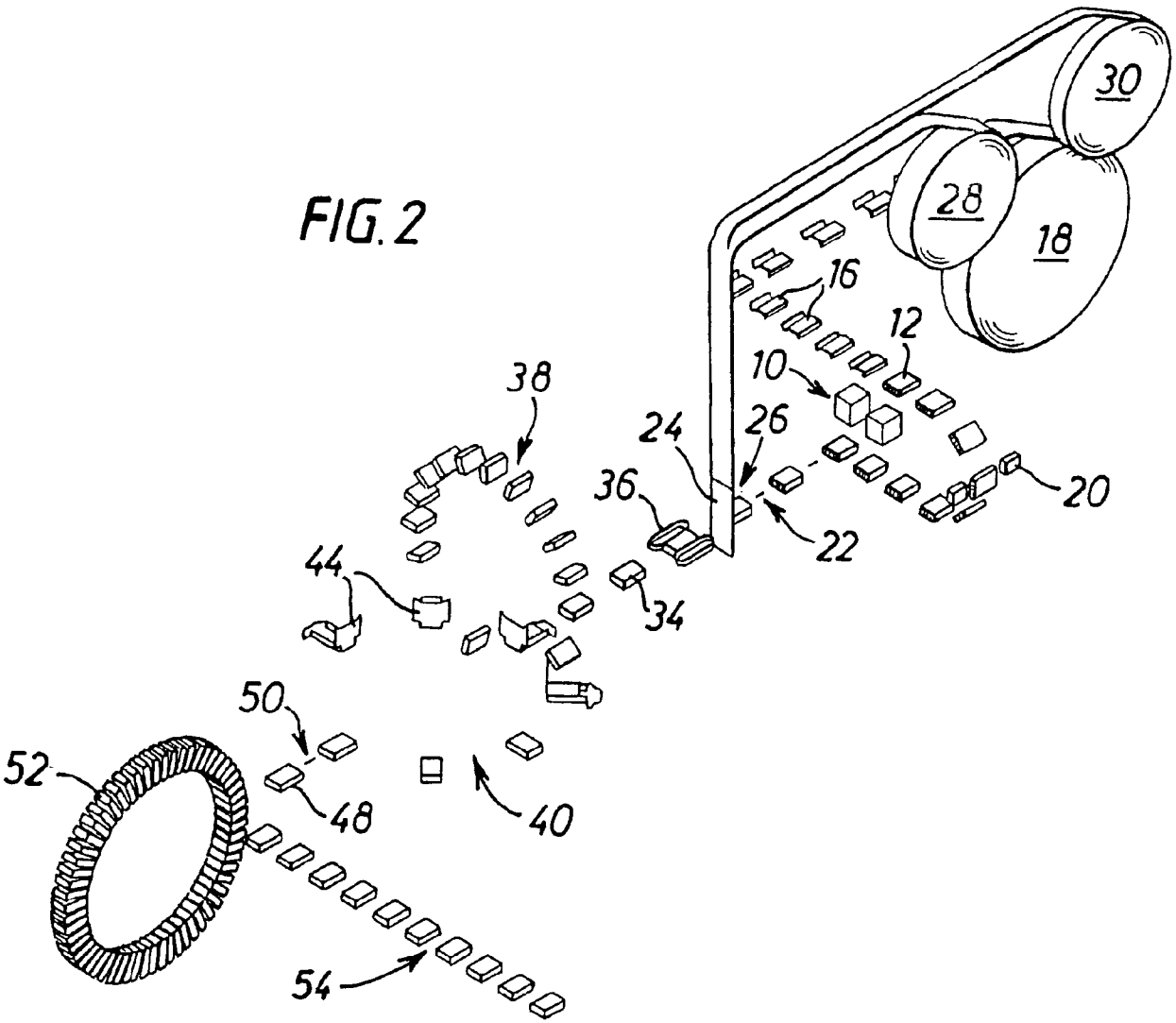
FIG. 2 is a view showing product feed through the machine of FIG. 1.

Referring to FIGS. 1 and 2, a machine for producing hinged lid packets containing wrapped cigarette groups, which may be in the form of resealable inner packs such as disclosed in said WO98/22367 or WO98/22368, includes a cigarette hopper 10, which delivers cigarettes downwards to a group forming region or regions in which, groups 12 of cigarettes are formed and subsequently plunged into individual pockets of a collation conveyor belt 14. The groups 12 are received in each pocket on an inner frame 16 delivered to the belt 14 at a position upstream of the hopper 10 and cut from an inner frame reel 18. Presence and condition of cigarettes in each group 12 are checked by ends detectors 20 alongside the belt 14.

Each cigarette group 12, together with its folded inner frame 16, is pushed from the pocket on belt 14 along a linear conveyor path 22 on which it intercepts a wrapper section 24 at a plunge position 26, such that the cigarette group 12 and inner frame 16 become partially enveloped in the wrapper section (ie the wrapper section forms a U around its leading end).

Each wrapper section 24 is a composite panel comprising an inner foil section, delivered from a reel 28, and an outer label section, delivered from a reel 30. The foil and label webs are delivered in overlying relationship to a cutting unit 32, which severs leading ends of the webs to form successive composite wrapper sections 24. Alternatively each wrapper section 24 may be obtained from a single reel, consisting of a foil web having pre-applied labels. As a further option, the wrapper sections 24 may be foil sections obtained from a single reel, each section being defined by perforations or pre-formed score lines across the web of the reel.

Figure 5:
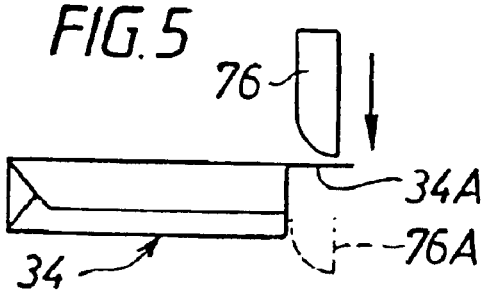
FIG. 5 is a view in the direction of arrow V in FIG. 4.

Downstream of the plunge position 26, wrapping and folding of the wrapper section 24 around the group 12 and inner frame 16 is partially completed in conventional manner, eg using plough and tuck folders as used on hinged lid packing machines manufactured by the applicants, to form a partially-completed pack 34. The form of the pack 34 is shown in FIG. 5. Tack heater bands 36 may be provided to temporarily hold the side flaps in place before the pack 34 is delivered to a pocketed sealing drum 38 at which heat sealing of the overlapped edges of the wrapper section 24 is completed. The material of each wrapper section 24 is heat-sealable. As an alternative, where the material is not heat-sealable, adhesive could be applied upstream of the bands 36.

After heat sealing has been completed in the sealing drum 38, the pack 34 is delivered to a blank folding turret 40, at which it is received in a pocket 42 in which a hinged lid blank 44 has already been received from a blank feed and gumming unit 46. The blank 44 is folded and sealed around the pack 34 in the turret 40. Delivery of completed packets 48 is by way of a linear conveyor 50 to a drying drum 52 at which the adhesive of the folded blank 44 is cured and/or dried so that finished packets may be delivered along an exit conveyor line 54.

It will be understood that movement of each of the pocketed conveyors 14, 38, 40, and 52 is generally intermittent and in steps corresponding to the pitch between adjacent respective pockets, so that at least transfer to or from the respective conveyor normally occurs while the conveyor is stationary, although in principle the machine may operate continuously.

The machine may readily be adapted to produce packs 34, ie without an outer hinged lid packet, by omission of the turret 40.

Figure 3:
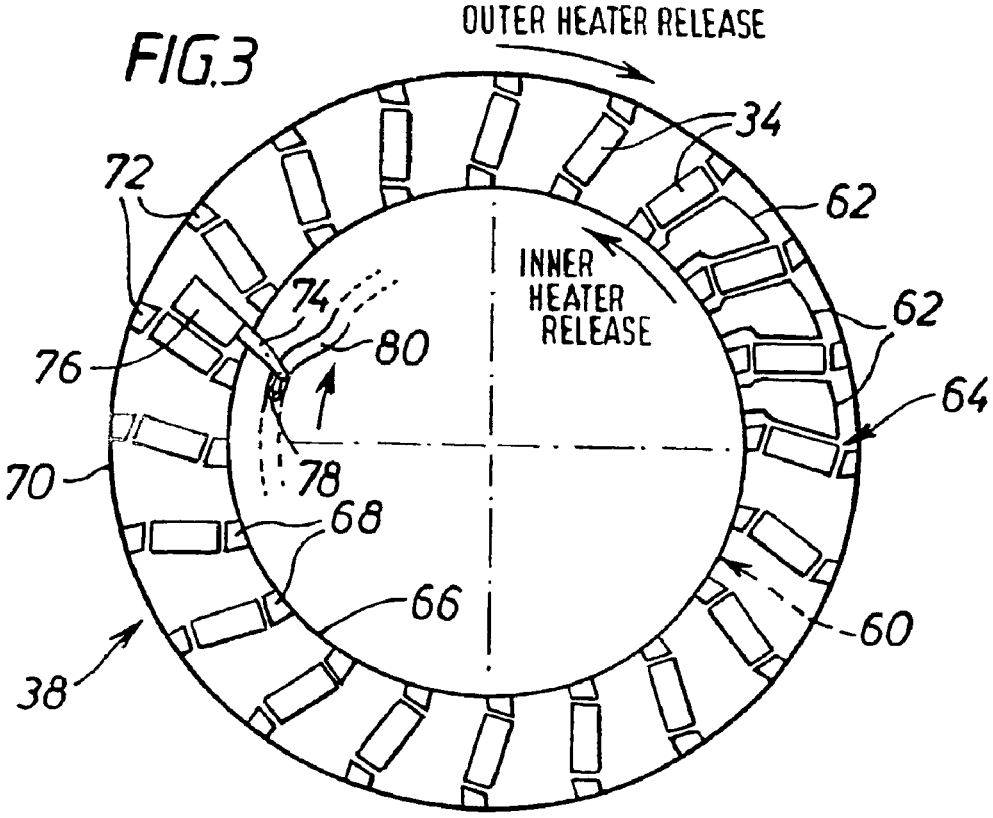
FIG. 3 is an end view of a sealing drum of the machine of FIG. 1.
Figure 4:
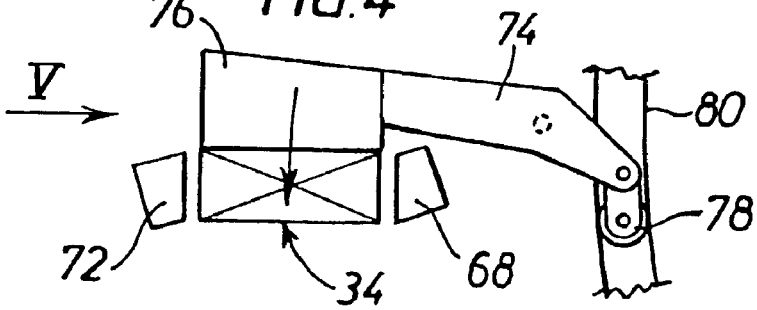
FIG. 4 is an enlarged view of a detail of the sealing drum shown in FIG. 3.

FIGS. 3–5 show more details of the sealing drum 38. This comprises a central hub 60 from which extend in a generally radial direction a series of profiled projections 62 (only three of which are shown in FIG. 3) which at least partially define between them the pockets 64 in which the packs 34 are held. Rotatable about the same axis as the hub 60 is an inner ring 66 carrying a series of circumferentially-spaced inner heater elements 68, and also an outer ring 70 carrying a series of circumferentially-spaced outer heater elements 72. In normal operation the hub 60 and rings 66 and 70 rotate intermittently together, with the heater elements 68 and 72 aligned with the pockets 64 so as to provide heat to seal the side seams of the packs 34. This is the position shown in FIG. 3. Note that the side faces of the projections 62 are not radial but are inclined at relatively small angles to a radial direction, so that packs 34 held in the pockets 64 are correspondingly inclined, as are the operating faces of the heater elements 68 and 72. When the machine is stopped, eg because of a malfunction, the inner and outer rings 66, 70 can be rotated relative to the central hub 60 by an amount sufficient to withdraw the respective heater elements 68, 72 from the faces of the packs 34 held in the pockets 64: this avoids overheating by prolonged contact between the packs and the heater elements. This displacement of the heater elements 68, 72 by relative rotation, which as shown in FIG. 3 consists of anti-clockwise movement of the inner ring 66 and clockwise rotation of the outer ring 70, is facilitated by the inclined orientation of the pockets 64 and corresponding faces of the heater elements.

The heater elements 68 and 72 complete side sealing of the longitudinal seams of the packs 34. End sealing, which is required only at the trailing end of each pack 34, is also carried out on the drum 38.

Associated with each pocket 64 and carried by the central hub 60 is a series of pivoted levers 74 (only one of which is shown in FIG. 3) each carrying at its outer end a heater element 76 and at its inner end a cam lever and roller 78 which is engaged in a stationary cam track 80. As best seen in FIGS. 4 and 5, the heater element 76 is aligned with the end of the pack 34 and is movable under operation of the cam roller 78 and cam track 80 from its position shown in the drawings to the position indicated at 76A in FIG. 5 at which an end flap 34A of the pack 34 is held and sealed against the main body of the pack. Note that the movement of the element 76 into its sealing position performs the operation of folding the end flap 34A. The heater element 76 is maintained in position against the pack for sufficient time to effect the seal, the cam track 80 being arranged so that subsequently the lever 74 is returned to the position shown in FIGS. 3 and 4 at least prior to the respective pockets 64 receiving a new pack 34. Means (not shown) may be provided for returning the lever 74 to its inoperative position (ie with the heater element 76 out of contact with the pack 34) if the machine stops for an extended period (so as to prevent overheating).

Figure 6:
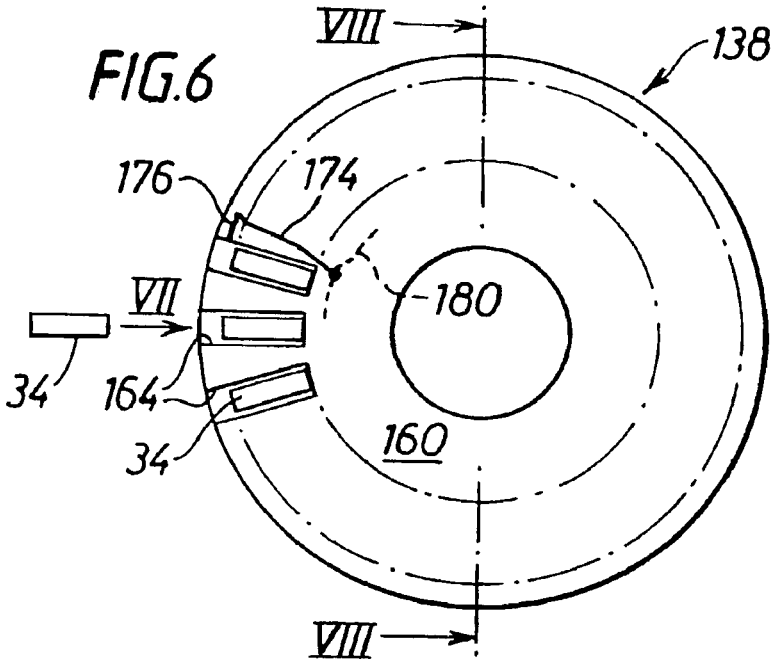
FIG. 6 is an end view of an alternative sealing drum usable in a machine similar to that of FIG. 1.
Figure 7:
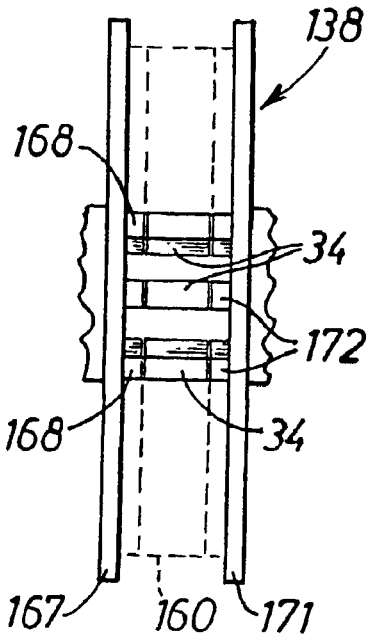
FIG. 7 is a view in the direction of arrow VII in FIG. 6.
Figure 8:
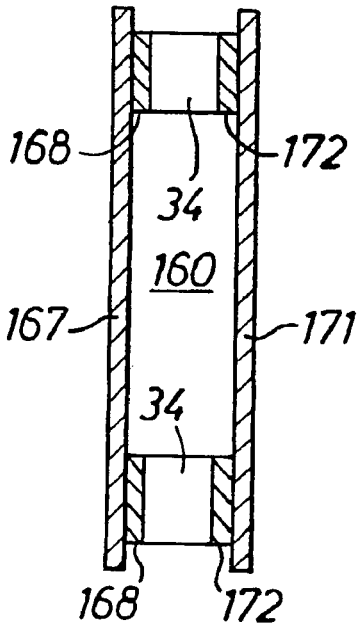
FIG. 8 is a sectional view on the line VIII—VIII in FIG. 6.

The orientation of the pack 34 in the pockets 64 corresponds with the orientation of the drum 38 as shown in FIGS. 1 and 2. FIGS. 6–8 illustrate an alternative drum 138 in which the axis of the drum is disposed at right angles to that of the drum 38 (ie the drum 138 is orientated in a plane parallel to that of the drum 52). In the drum 138 pockets 164 are defined- and carried by a central drum assembly 160. Heater elements 168, 172, which engage with respective side seams of the packs 34 in the pockets 164, are carried by respective discs 167, 171 which are coaxial and rotatable with the hub assembly 160 and disposed adjacent the opposite end faces of the assembly. The discs 167, 171 can be rotated relative to the assembly 160 to displace the heater elements 168, 172 from the side seams of the packs 34 in the event that the machine stops for an extended period. In the drum 138 the pockets 164 may be so arranged that the respective packs 34 are disposed so that their side faces are slightly inclined to a plane which is perpendicular to the axis of the drum. The operative faces of the heater elements 168, 172 may be correspondingly inclined. In this way, on rotation of the discs 167, 171 to displace the heater elements 168, 172 from the side seams of the packs 34, separation may be achieved without rubbing or sliding movement of the heater elements across the respective side face.

End sealing of the pack 34 in the drum 138 may be carried out by a cam-operated pivoted lever 174 carrying a heater/folder element 176, as indicated schematically in FIG. 6, which cooperates with a cam track 180 in an analogous manner to operation of the lever 74 and element 76; note that the heater/folder element 176 is disposed in a circumferential plane to correspond with the orientation of the packs 34 in the pockets 164.

What is claimed is:

1. Apparatus for wrapping articles, particularly articles consisting of or containing groups of rod-like articles, comprising a rotary conveyor provided with a series of locations each of which is arranged to receive at a first rotational position of the conveyor an article and a wrapper at least partly surrounding the article and having at least one overlapped region, and heat sealing means carried with the conveyor and arranged to heat seal said overlapped region before discharge of the article and wrapper at a second rotational position of the conveyor, wherein the heat sealing means comprises a series of first and second opposed heater means associated with each location for heat sealing overlapped regions on opposite sides of an article at said location.

2. Apparatus as claimed in claim 1, wherein the rotary conveyor comprises a pocketed drum.

3. Apparatus as claimed in claim 1, including means for moving said respective heater means into and out of operative positions at said locations.

4. Apparatus as claimed in claim 3, wherein said locations are disposed so as to present respective faces of articles at orientations inclined with respect to radial directions of said rotary conveyor, and said heater means are provided with correspondingly inclined faces, so as to facilitate displacement of said heater means relative to said articles by said moving means.

5. Apparatus as claimed in claim 1, wherein the heat sealing means comprises a series of end seal heaters, each of which includes an actuable element movable into and out of an operative position with a respective location.

6. Apparatus as claimed in claim 5, wherein the actuable element is arranged to complete a folding action on a wrapper of an article in said respective location on movement into said operative position.

7. Apparatus as claimed in claim 6, wherein the actuable element includes a pivoted lever operated by cam means on rotation of said rotary conveyor.

8. Apparatus as claimed in claim 5, wherein the actuable element is movable in a plane which is transverse to an axis of the rotary conveyor.

9. Apparatus as claimed in claim 5, wherein the actuable element is movable in a plane which is generally parallel to an axis of the rotary conveyor.

10. Apparatus as claimed in claim 1, including means for delivering successive articles to said rotary conveyor at said first rotational position in a direction substantially parallel to an axis of said rotary conveyor.

11. Apparatus as claimed in claim 10, including means for transferring wrapped articles from said rotary conveyor towards further rotary conveyor means in a direction parallel to the direction of conveyance of said delivering means.

12. Apparatus as claimed in claim 1, including means for delivering successive articles to said rotary conveyor at said first rotational position in a direction substantially transverse to an axis of said rotary conveyor.

13. Apparatus for wrapping articles, particularly articles consisting of or containing groups of rod-like articles, comprising a rotary conveyor provided with a series of locations each of which is arranged to receive at a first rotational position of the conveyor an article and a wrapper at least partly surrounding the article and having at least one overlapped region, and heat sealing means carried with the conveyor and arranged to heat seal said overlapped region before discharge of the article and wrapper at a second rotational position of the conveyor, wherein the heat sealing means comprises a series of heater means, at least one heater means being associated with each of said locations, and wherein at least one said series of heater means is mounted on a carrier, said carrier being rotatably displaceable about the axis of the rotary conveyor relative to said locations.

14. Apparatus as claimed in claim 13, wherein said displacing means comprises means for rotationally displacing said carrier relative to an axis of said rotary conveyor.

15. Apparatus as claimed in claim 13, wherein said carrier is annular and supports said heater means in radially outer or radially inner positions relative to said locations.

16. Apparatus as claimed in claim 15, wherein said carrier supports a series of first heater means in a radially outer position, including a further annular carrier supporting a series of second heater means in a radially inner position.

17. Apparatus as claimed in claim 13, wherein said carrier supports said heater means in axially adjacent positions relative to said locations.

18. Apparatus as claimed in claim 17, wherein said carrier supports a series of first heater means in an axially adjacent position on one side of said locations, including a further carrier supporting a series of second heater means in an axially adjacent position on the other side of said locations.

19. Apparatus as claimed in claim 13, wherein the rotary conveyor comprises a pocketed drum.

20. Apparatus as claimed in claim 13, wherein said locations are disposed so as to present respective faces of articles at orientations inclined to radial directions of said rotary conveyor, and said heater means are provided with correspondingly inclined faces, so as to facilitate displacement of said heater means relative to said articles by said moving means.

21. Apparatus as claimed in claim 13, wherein the heat sealing means comprises a series of end seal heaters, each of which includes an actuable element moveable into and out of an operative position with a respective location.

22. Apparatus as claimed in claim 21, wherein the actuable element is arranged to complete a folding action on a wrapper of an article in said respective location on movement into said operative position.

23. Apparatus as claimed in claim 22, wherein the actuable element includes a pivoted lever operated by cam means on rotation of said rotary conveyor.

24. Apparatus as claimed in claim 21, wherein the actuable element is movable in a plane which is transverse to an axis of the rotary conveyor.

25. Apparatus as claimed in claim 21, wherein the actuable element is movable in a plane which is generally parallel to an axis of the rotary conveyor.

26. Apparatus as claimed in claim 13, including means for delivering successive articles to said rotary conveyor at said first rotational position in a direction substantially parallel to an axis of said rotary conveyor.

27. Apparatus as claimed in claim 13, including means for delivering successive articles to said rotary conveyor at said first rotational position in a direction substantially transverse to an axis of rotary conveyor.

28. Apparatus as claimed in claim 27, including means for transferring wrapped articles from said rotary conveyor towards further rotary conveyor means in a direction parallel to the direction of conveyance of said delivering means.

29. Apparatus as claimed in claim 26, including means for transferring wrapped articles from said rotary conveyor towards further rotary conveyor means in a direction parallel to the direction of conveyance of said delivering means.

* * * * *